US006691493B1

(12) United States Patent
von Bismarck

(10) Patent No.: US 6,691,493 B1
(45) Date of Patent: Feb. 17, 2004

(54) METHOD OF AND APPARATUS FOR ENCODING AND RECORDING IDENTIFYING INDICIA FOR ARRAYS OF ROD-SHAPED COMMODITIES

(75) Inventor: Gottfried von Bismarck, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 198 days.

(21) Appl. No.: 09/671,585

(22) Filed: Sep. 28, 2000

(30) Foreign Application Priority Data

Sep. 30, 1999 (DE) ..... 199 47 282

(51) Int. Cl.[7] ..... B65B 61/00

(52) U.S. Cl. ..... 53/410; 53/128.1; 53/236; 53/52; 131/333; 131/331; 131/908

(58) Field of Search ..... 53/415, 444, 501, 53/52, 148, 236, 128.1, 473, 410; 116/204; 131/333, 331, 908

(56) References Cited

U.S. PATENT DOCUMENTS

| | | | | | |
|---|---|---|---|---|---|
| 3,616,901 | A | * | 11/1971 | Groves | 209/535 |
| 3,625,226 | A | * | 12/1971 | Flesselles | 131/361 |
| 3,828,796 | A | * | 8/1974 | Finn | 131/61.1 |
| 3,974,007 | A | | 8/1976 | Greve | |
| 4,044,526 | A | * | 8/1977 | Lafleur | 198/419.1 |
| 4,227,400 | A | | 10/1980 | Nienow et al. | |
| 4,365,703 | A | * | 12/1982 | Hinchcliffe et al. | 198/347.1 |
| 4,412,505 | A | | 11/1983 | Haüsler et al. | |
| 4,471,866 | A | | 9/1984 | Erdmann et al. | |
| 4,746,052 | A | * | 5/1988 | Schmissrauter | 206/807 |
| 4,746,556 | A | * | 5/1988 | Matsuguchi et al. | 283/101 |
| 4,836,378 | A | | 6/1989 | Lephardt | |
| 5,135,008 | A | | 8/1992 | Oesterling et al. | |
| 5,203,591 | A | * | 4/1993 | Treat | 235/494 |
| 5,506,876 | A | * | 4/1996 | Homer | 346/143 |
| 5,895,075 | A | * | 4/1999 | Edwards | 283/100 |

FOREIGN PATENT DOCUMENTS

| | | | | |
|---|---|---|---|---|
| DE | 196 45 630 A1 | | 5/1998 | |
| DE | 198 27 412 A1 | | 12/1999 | |
| DE | 197 34 828 A1 | | 2/2000 | |
| EP | 0 317 202 | | 5/1989 | |
| EP | 0542 449 A1 | * | 10/1992 | B65D/5/54 |
| EP | 0 787 656 | | 8/1997 | |
| EP | 0 967 161 A1 | | 12/1999 | |
| GB | 2 337 974 A1 | | 12/1999 | |

* cited by examiner

*Primary Examiner*—Rinaldi I. Rada
*Assistant Examiner*—Louis Tran
(74) *Attorney, Agent, or Firm*—Venable LLP; Robert Kinberg; Chad C. Anderson

(57) ABSTRACT

Packs of rod-shaped smokers' products comprise containers of a material which permits monitoring of their contents by a suitable detector serving to generate signals which indicate the presence of characteristic indicia on one or more packed smokers' products. Such signals are encoded and the encoded information is applied to the respective containers. The information can be decoded and compared with signals furnished by the detector in order to ascertain whether or not the smokers' products are genuine, i.e., made by the manufacurer whose trademark(s) and/or other identifying information appear or appears on the containers.

9 Claims, 3 Drawing Sheets

METHOD OF AND APPARATUS FOR ENCODING AND RECORDING IDENTIFYING INDICIA FOR ARRAYS OF ROD-SHAPED COMMODITIES

CROSS-REFERENCE TO RELATED CASES

This application claims the priority of commonly owned German patent application Serial No. 199 47 282.3 filed Sep. 30, 1999. The disclosure of the above-referenced German patent application, as well as that of each U.S. and foreign patent and patent application identified in the specification of the present application, is incorporated herein by reference.

BACKGROUND OF THE INVENTION

The present invention relates to the making and confinement of groups of discrete commodities, such as arrays of plain or filter cigarettes or other types of rod-shaped articles of the tobacco processing industry. Typical examples of commodities which can be made and treated in accordance with the method and in the apparatus of the present invention are so-called soft and hinged-lid packs of plain or filter cigarettes. Therefore, this specification will discuss primarily the making and further processing of packs of cigarettes and of the contents of such packs but with the understanding that the invention can be practiced with equal or similar advantage in connection with the making and processing of containers for other discrete products of the tobacco processing industry as well as of commodities in fields of endeavor other than the making, packing and other modes of processing of smokers' products.

It is customary to confine arrays of, e.g., five, ten, nineteen or twenty cigarettes in packets each of which is made of two or more layers of suitable wrapping material. For example, a so-called hinged-lid pack can contain an array of twenty cigarettes in the customary quincunx formation, an inner envelope of a metallic sheet material (such as tinfoil), a second envelope or box made of cardboard or plastic material and surrounding the array, the inner envelope as well as a customary stiffening collar, and an outermost envelope consisting of cellophane or other suitable transparent or translucent sheet material and often containing a so-called tear strip or tear tape. The outermost envelope surrounds the box and must be removed, at least in part, in order to afford access to the pivotable lid of the box.

It is becoming progressively more popular and more advisable to provide a technique of detecting the existence of forgeries, i.e., to establish a procedure which enables a person or an organization to ascertain whether or not commodities provided with the trademark(s) and/or other indicia denoting the products offered for sale by a reputable manufacturer of cigarettes or other types of grouped rod-shaped commodities are properly labelled or are products offered for sale or being sold by imitators. The detection of forgeries or the absence of requisite numbers of cigarettes in an array is rendered more difficult because a soft pack or a hinged-lid pack of cigarettes must be opened if an inspector or an apparatus is to gain access to the contents of the pack.

Otherwise stated, it is advisable to ensure that the information borne by the visible parts of a cigarette pack (i.e., the information at the exterior of that envelope or those envelopes which can be inspected without opening the pack) is truly indicative of the quantity and/or origin of the contents of the pack.

OBJECTS OF THE INVENTION

An object of the invention is to provide a method of facilitating the identification (such as the ascertainment of genuineness or lack of genuineness) of the contents of containers or receptacles or packets for discrete commodities or groups of commodities, such as arrays of cigarettes or other rod-shaped articles of the tobacco processing industry, without it being necessary to open the containers.

Another object of the invention is to provide a method of making and/or processing discrete commodities (such as plain or filter cigarettes) and/or their containers in such away that the genuineness or lack of genuineness of the products can be ascertained without it being necessary to destroy the containers and/or otherwise alter the condition (such as the appearance and/or the dimensions) of the containers.

A further object of the invention is to provide a novel series of steps of associating the contents of cigarette packs or the like with the maker or makers of the contents and/or the containers in a simple, time saving and relatively inexpensive manner.

An additional object of the instant invention is to provide a novel and improved apparatus for the practice of the above outlined method.

Still another object of the present invention is to provide a machine or apparatus which is constructed and assembled to make readily identifiable products, such as cigarettes or other types of rod-shaped commodities, namely products the origin of which can be readily ascertained without the need for affecting the integrity of the packs or other types of containers which confine and normally also conceal the products.

A further object of the invention is to provide novel and improved means for facilitating the identification of plain or filter cigarettes or analogous rod-shaped smokers' products while the products are confined and concealed in packs and/or other types of receptacles or containers.

Another object of the invention is to provide a novel and improved attachment which can be associated with existing makers of rod-shaped smoker' products for the purpose of facilitating the practice of the above outlined novel method.

An additional object of the invention is to provide rod-shaped smoker' products, groups or arrays of such products, and packs or other types of containers or receptacles for such arrays, which render it possible to practice the above outlined method by resorting to the above outlined apparatus.

Still another object of the present invention is to provide a novel and improved technique of facilitating the detection of imitations of established smoker' products.

A further object of the invention is to provide novel and improved filter mouthpieces for use in the making of filter cigarettes or other filter tipped smoker' products.

SUMMARY OF THE INVENTION

One feature of the present invention resides in the provision of a method of facilitating identification of the contents of a container (such as a multiple-layer packet) for a group of commodities (such as an array of parallel rod-shaped smoker' products). The improved method comprises the steps of providing the group with at least one identifying indicium, confining the group in a container, generating at least one signal which is indicative of the at least one indicium, encoding the at least one signal, and applying to the container at least one decodable symbol which is indicative of the encoded at least one signal.

As mentioned above, the group can constitute a block-shaped array of rod-shaped articles of the tobacco processing industry. The confining step can include draping the array into successive blanks of suitable wrapping material. Each blank can consist of a different wrapping material.

The at least one indicium can constitute a composite indicium, and the method wherein the providing step includes providing the group with a composite indicium can further comprise the step of making the commodities. The providing step can include furnishing or providing at least some of the commodities with portions of identifying indicia in the course of the making step (e.g., in the course of the step of making filter rod sections or filter mouthpieces which are thereupon assembled with plain cigarettes into filter cigarettes).

If the at least one indicium is a composite indicium, the providing step can include furnishing or providing at least some of the commodities with portions of a composite indicium. The signal generating step of such method can include generating at least one signal which is indicative of mutual positions of portions of the composite indicium in the group.

The container and the at least one identifying indicium can be of such nature that the indicium is detectable through the container. The signal generating step of such method can include monitoring the group subsequent to the confining step.

In accordance with one presently preferred embodiment of the improved method, the providing step can include applying to at least one commodity of the group at least one foreign object (e.g., a strip of a metallic material) which is detectable through the container.

Another feature of the present invention resides in the provision of a method of ascertaining the integrity of the contents of a container which confines at least one discrete commodity (e.g., a group or array or formation of parallel rod-shaped articles). The method comprises the steps of associating the at least one commodity with at least one identifying indicium, confining the thus identified at least one commodity in the container (e.g., in the box of a hinged-lid cigarette pack), monitoring the at least one identifying indicium to gather information denoting the thus detected identifying indicium, encoding the thus gathered information, and applying the encoded information to the container.

The monitoring step can be carried out subsequent to the confining step if the at least one identifying indicium is selected and associated with (e.g., applied to) the at least one commodity in such a way that it is detectable through the container (e.g., through several envelopes of a cigarette pack).

If the contents of the container consist of an array of rod-shaped smoker' products, the associating step of the method can include providing at least some smoker' products of the array with portions of a composite encoded information.

The associating step can include providing the commodity with a pattern of randomly distributed portions of a composite identifying indicium. The monitoring step of such method can be carried out prior to the confining step.

For example, the monitoring step can include ascertaining the position and/or the characteristics of the at least one identifying indicium.

When desired or necessary, the method can further include the steps of decoding the applied information and comparing the decoded information with the information obtained as a result of the monitoring step. Such monitoring step can include ascertaining the position of the at least one identifying indicium. Alternatively, the monitoring step can include generating a plurality of first signals, and such method can further comprise the step of generating a second signal which denotes the sum of the first signals; the encoding step of such method includes encoding the second signal.

The associating step can include associating the at least one commodity with an identifying indicium which is detectable through the container by at least one of a plurality of detectors including acoustic, electrical, magnetic, electromagnetic, high-frequency, microwave and X-ray detectors.

Still further, the associating step of the discussed method can include providing the at least one commodity with at least one internal and/or external identifying indicium or criterion. If the at least one commodity exhibits at least one criterion the presence or absence of which can be interpreted as an identifying indicium, the associating step can include depriving the at least one commodity of the at least one criterion.

A further feature of the present invention resides in the provision of an apparatus for facilitating identification of the contents of a container for a group of commodities at least one of which exhibits at least one identifying indicium. The apparatus comprises means for generating at least one signal which is indicative of the at least one identifying indicium, means for encoding the at least one signal, and means for applying to the container at least one decodable symbol which is indicative of the encoded signal or signals.

The apparatus can further comprise means for decoding the applied symbol or symbols, and means for comparing the decoded symbol or symbols with the at least one signal which was generated by the signal generating means.

The apparatus can also comprise means for providing the at least one commodity of the group with at least one feature which causes the at least one commodity to exhibit the at least one identifying indicium. In order to facilitate identification of the contents of a container for a group of nonmetallic commodities, the providing means can include means for combining the at least one commodity with at least one metallic particle (e.g., with a strip of a suitable metallic material). The nonmetallic commodities can comprise tubular envelopes, and the at least one metallic particle can be provided at (i.e., on or in) the envelope of the at least one commodity.

An additional feature of the present invention resides in the provision of a smoker' product (such as a plain or filter cigarette, cigar, cigarillo or the like) which comprises a first portion (such as the rod-like tobacco filler and the tubular wrapper of a plain cigarette) and a second portion which constitutes at least one characteristic or identifying indicium for the first portion. For example, the second portion can constitute at least one piece (such as a strip) of a metallic material. In accordance with one embodiment, the product can constitute a filter cigarette, cigar or cigarillo, and its first portion can include or constitute a filter for tobacco smoke; the at least one piece of metallic material is or can be integrated into a haphazardly (i.e., randomly) chosen part of the filter.

The novel features which are considered as characteristic of the invention are set forth in particular in the appended claims. The improved apparatus itself, however, both as to its construction and the mode of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
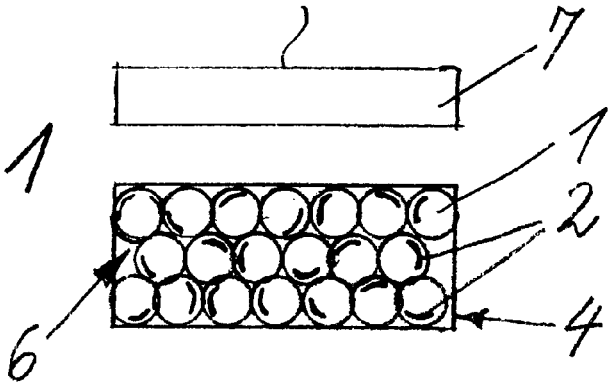
FIG. 1 is a somewhat schematic front elevational view of a cigarette pack containing an array of twenty filter cigarettes provided with identifying indicia required for the practice of the improved method, there being further shown a detector which can be utilized to generate one or more signals that is or are indicative of the identifying indicia.
Figure 2:
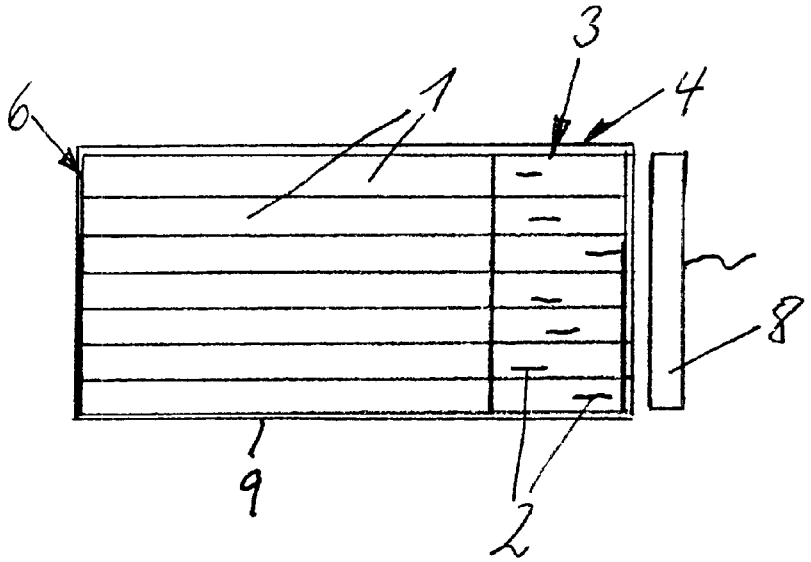
FIG. 2 is a plan view of the cigarette pack of FIG. 1, with one wall of the packet omitted, and further shows a second detector for the identifying indicia which are carried by the filter mouthpieces of the filter cigarettes.

FIG. 1 shows a group or array 6 of twenty filter cigarettes 1 in a so-called quincunx formation. Thus, the two outer layers contain seven cigarettes 1 each, and the median layer contains six cigarettes which are parallel to but laterally offset relative to the cigarettes of the two outer layers. As can be seen in FIG. 2, the filter mouthpiece 3 of each filter cigarette 1 in the outer layer shown in FIG. 2 is provided with an indicium 2 in the form of a relatively short magnetically detectable metallic strip extending in parallelism with the axis of the respective filter cigarette. The indicia can be glued to the inner or outer sides of tubular wrappers of the respective filter mouthpieces 3, or they can be confined in the filter material of the respective mouthpiece (i.e., within the tubular wrapper) in a haphazard (random) fashion.

The other two layers of the quincunx formation or group 6 in the envelope or packet 9 of the (soft or hinged-lid) pack 4 shown in FIGS. 1 and 2 may (see FIG. 1) but need not be provided with identifying indicia 2. In fact, the entire pack 4 can contain a single filter cigarette 1 with a filter mouthpiece 3 which is provided with an identifying indicium 2.

The identifying indicium of indicia 2 can be introduced into or applied to the filter mouthpieces 3 in a filter rod making machine, e.g., in a machine of the type disclosed in U.S. Pat. No. 3,974,007 granted Aug. 10, 1976 to Greve for "METHOD AND APPARATUS FOR THE PRODUCTION OF FILTER ROD SECTIONS OR THE LIKE". The strip or strips 2 of a single mouthpiece 3 or of two or more (e.g., all) filter mouthpieces in a group or array 6 can be said to constitute the characteristic indicium or indicia of the entire contents of the packet 9 of the cigarette pack 4.

The strip or strips 2 can constitute small or minute fragments of metallic sheet material or minute or relatively large films of metallic powder applied to layers of adhesive on the tubular wrapper or wrappers of one or more filter mouthpieces 3. All that counts is to ensure that the identifying indicium or indicia constituted by the metallic parts 2 be readily detectable prior or subsequent to confinement of the group 6 in one or more converted blanks constituting the packet 9 of the cigarette pack 4.

The strip or strips 2 can be applied directly to the respective filter mouthpieces 3 (e.g., to the tubular wrappers which directly surround the filter material for tobacco smoke) or indirectly, namely by attaching or applying such strips to the so-called tipping paper which is utilized to connect prefabricated plain cigarettes of unit length with prefabricated filter mouthpieces. The manner of dividing a running web of tipping paper into discrete uniting bands which are utilized to connect successive filter mouthpieces of double unit length with successive pairs of plain cigarettes of unit length (to obtain groups of three coaxial rod-shaped articles) and of converting the thus obtained filter cigarettes of double unit length into filter cigarettes of unit length is disclosed, for example, in commonly owned U.S. Pat. No. 5,135,008 granted Aug. 4, 1992 to Oesterling et al. for "METHOD OF AND APPARATUS FOR MAKING FILTER CIGARETTES".

FIG. 1 shows a detector 7 which is set up to generate at least one signal indicative of the randomly distributed indicia 2 in the packet 9 of the cigarette pack 4. The group 6 in the pack 4 of FIG. 1 can be moved below and along the detector 7 in such a way that the filter cigarettes 1 advance lengthwise or sideways. The detector 7 can constitute a permanent magnet or an electromagnet. Depending upon the nature of the identifying indicia 2 or of their equivalents, the detector 7 or its equivalent can be set up to generate acoustic, electrical, magnetic, electromagnetic, high-frequency, microwave and/or X-ray signals.

The packet 9 of the cigarette pack 4 can comprise two or more envelopes which can constitute converted blanks made of a metallic sheet material (such as tinfoil or another suitable metallic foil), of cardboard, and of transparent or translucent plastic sheet stock with or without a tear strip or tear tape.

Alternatively, or in addition to the detector 7 of FIG. 1, the apparatus which generates and processes signals denoting the composite identifying indicium composed of portions constituted by the strips 2 can comprise a detector 8 which is shown in FIG. 2 adjacent the path of exposed free ends of filter mouthpieces in the cigarette pack 4. The filter cigarettes 1 advance past the detector 8 while moving sideways, i.e., upwardly or downwardly as viewed in FIG. 2, or sideways but toward or away from the observer of FIG. 2. The thus generated signal is also indicative of the number as well as of the distribution of the portions 2 of the composite identifying or characteristic indicium for the group 6, i.e., for the array of twenty filter cigarettes 1 in the pack 4 of FIG. 2. The detector 8, too, is assumed to be of the character capable of generating an appropriate signal (or a set of signals) through the adjacent portion (end wall) of the packet 9 forming part of the cigarette pack 4 shown in FIG. 2. For example, the detector 8 can include or constitute at least one permanent magnet or at least one electromagnet.

The signal or signals generated by the detector 7 and/or 8 is or are thereupon encoded to furnish at least one visible but preferably latent symbol which is applied to the packet 9 of the cigarette pack 4 and can be decoded (if and when necessary) to ascertain the genuineness or lack of genuineness of the group or array 6 of cigarettes 1 actually confined in the packet 9. This can be achieved by comparing the decoded signal with the information which was furnished by the detector or sensor 7 and/or 8 during scanning of the composite identifying indicium represented by the strips 2 while the pack 4 was being advanced past the monitoring station of FIG. 1 or 2 (or vice versa).

An improperly applied symbol (information) is or is likely to be destroyed during normal opening of a cigarette pack which was produced by a competitor of the authorized maker of a brand to which the filter cigarettes 1 belong. Alternatively, if a pack 4 contains a symbol or other information purporting to be a symbol denoting the indicium or indicia represented by the symbol or symbols on the packet 9 of a cigarette pack, a decoding of such information is followed by a comparison of decoded information with the recorded signals denoting the information which was gathered by the detector 7 and/or 8 during advancement of the pack 4 therealong.

It will be appreciated that the metallic strips or layers 2 constitute but one of numerous identifying indicia which can be applied to the contents of successive (genuine) packs 4 in order to ascertain the genuineness or lack of genuineness of the contents of successive or selected cigarette packs. The nature of the detector 7 and/or 8 (or of another type of detector) will depend upon the characteristics of the identifying indicium or indicia.

An advantage of the improved method and apparatus is that, if the detector(s) can ascertain the presence and/or the nature (such as the distribution and/or the number and/or other characteristics) of the indicium or indicia borne by or confined within the constituents of the group 6 from the outside of the packet 9, it is not even necessary to open the packet of a pack which is to be examined. All that is necessary is to memorize the information which was available to the detector 7 and/or 8 during advancement of the cigarette pack therealong and to compare such information with that represented by the symbol or symbols applied to the exterior of the packet 9.

It is further clear that the characteristic identifying indicia (such as the strips 2) need not be actually applied to the filter cigarettes 1 during the making of such smoker' products in a production line. Thus, if the cigarettes 1 exhibit certain characteristics (e.g., the composition of their uniting bands) which are proprietary to the authorized maker of the packs 4, and if such characteristics can be reliably ascertained prior or subsequent to confinement of the groups 6 in packets 9, the step of providing the mouthpieces 3 with strips 2 can be dispensed with.

An advantage of the feature that the strips 2 and/or other identifying indicia (or parts of such indicia) can be in a random (haphazard) distribution is that the manner in which the filter cigarettes and/or their parts move and/or are coupled to each other and/or are assembled into groups or arrays cannot, influence the accuracy and reliability of the improved method and apparatus. The reason is that the detector 7 and/or 8 can be installed to generate one or more signals denoting the identifying indicia 2 of the group 6 subsequent to confinement of the formation in the packet 9 of the cigarette pack 4, i.e., when the positions of filter cigarettes 1 in the group 6 relative to each other no longer undergo any changes. Thus, the identifying indcia of successive packs 4 remain unchanged.

Of course, such requirement need not be observed if the cigarettes 1 exhibit certain indicia which can be resorted to in order to ascertain the maker of cigarettes and/or of the packets 9 irrespective of whether the cigarettes which form a group or array or which are about to form an array have been caused to advance through and beyond the detecting station or stations prior or subsequent to finalizing of their positions relative to each other.

It is also possible to employ one or more detectors which generate a discrete first signal in response to detection of each portion or fragment of a composite identifying indicium, and to thereupon generate a second signal which corresponds to the sum of first signals pertaining to a group 6. The second signal is encoded, and the encoded information is applied to the container 9 for the pack 4 in the form of at least one decodable symbol.

Still further, it is possible to provide each group 6 with an identifying or characteristic indicium which is obtained by depriving one or more constituents (such as filter cigarettes 1) of one or more criteria. For example, one can leave out one or more customary ingredients from cigarette paper, from the wrapping material for the filter mouthpieces, and/or from the material (e.g., artificial cork) of the tipping paper; the absence of such ingredient(s) and/or constituent(s) is ascertained by a properly designed detector and serves as an identifying indicium for the group 6.

An important advantage of the improved method and apparatus, especially of the method and apparatus which are designed to generate, encode and imprint information accurately designating randomly distributed portions of composite identifying indicia, is that an imitator cannot prevent accurate determination of the origin of the contents of the packets 9 and/or the origin of the entire cigarette pack. Thus, the authorized maker and packer of cigarettes can protect her, his or its reputation by being in a position to rapidly and reliably ascertain the presence of imitations which attempt to infringe the trademark(s), patent(s) and/or other proprietary rights of the authorized maker.

Figure 3:
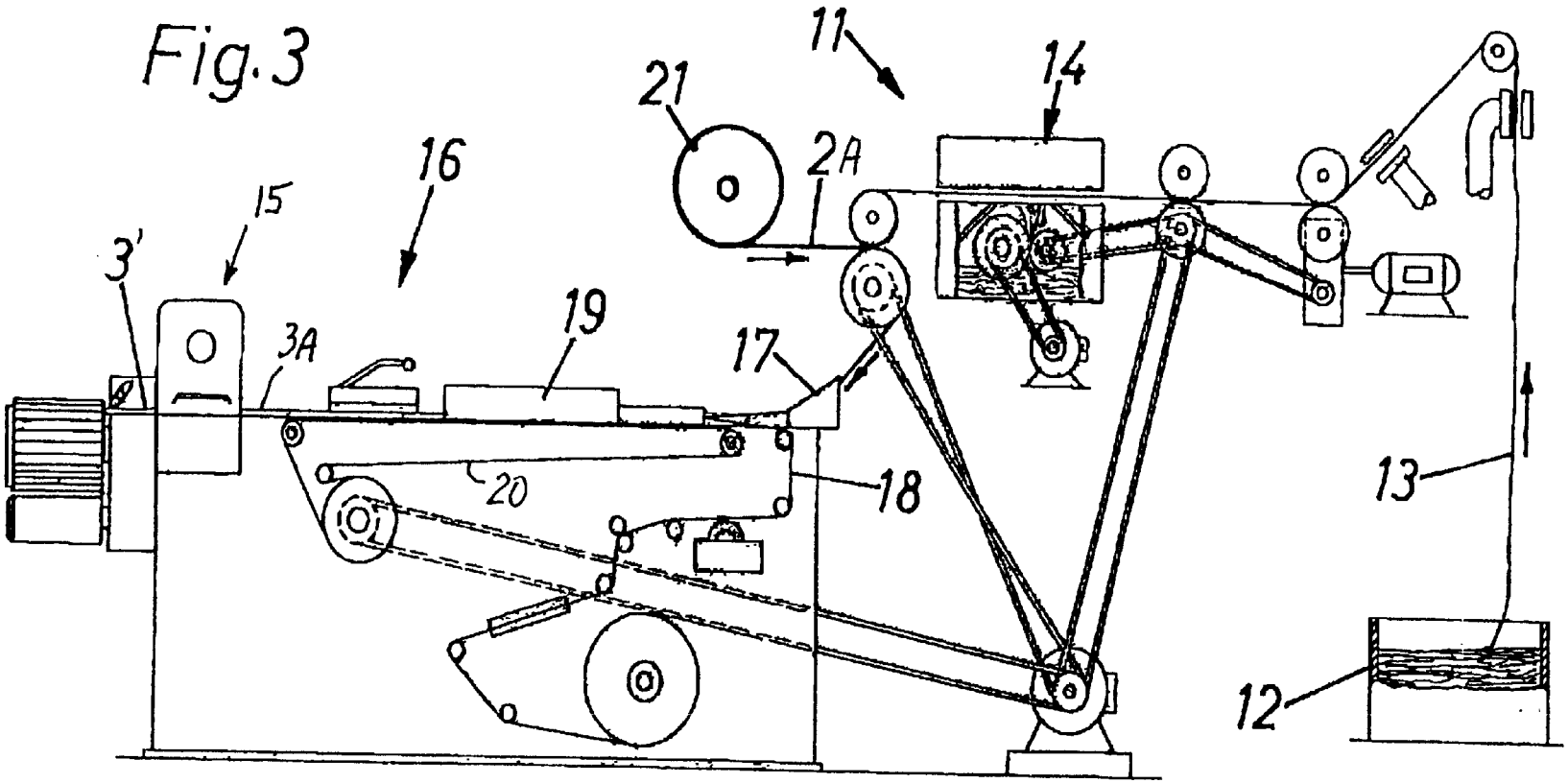
FIG. 3 is a schematic front elevational view of a standard filter rod making machine which is equipped with means for providing filter mouthpieces with identifying indicia different in size from those embodied in the filter cigarettes shown in FIGS. 1 and 2.

FIG. 3 shows certain details of a filter rod making machine which is similar to that disclosed in the aforementioned U.S. Pat. No. 3,974,007 to Greve. Another filter rod making machine of the general character shown in FIG. 3 is described and illustrated in commonly owned U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE".

The machine of FIG. 3 comprises a tow processing or tow preparing first section 11 serving to apply a suitable atomized plasticizer to a stretched running tow 13 of filamentary filter material. The tow 11 is drawn off a bale 12 and is loosened, stretched and sprayed with plasticizer (at 14) on its way to a gathering horn 17 ahead of a wrapping section 16. Successive increments of the tow 13 leaving the gathering horn 17 are draped into a running web 18 of wrapping material (such as cigarette paper). Conversion of the web 18 into the tubular wrapper of the thus obtained filter rod 3A is completed at the station 19 including a conveyor 20 known as garniture. The filter rod 3A is repeatedly severed at 15 to yield a file of successive filter rod sections 3' of unit length or multiple unit length, depending upon the nature of the filter tipping machine which receives filter rod sections 3' from the machine of FIG. 3. A presently preferred tipping machine is that disclosed in the aforementioned U.S. Pat. No. 5,135,008 to Oesterling et al.

FIG. 3 further shows a reel 21 serving as a source of a web 2A which is caused to advance with the running tow 13 into the gathering horn 17 and thence to the station 19 where it is draped into the wrapping material 18 to form part of the filter rod 3A. The web 2A advances and is repeatedly severed (at 15) jointly with the filter rod 3A to constitute a strip 2' (see FIG. 4) in each of the thus obtained discrete filter rod sections or mouthpieces 3'.

A difference between the filter rod section 3' which is obtained in the machine of FIG. 3 and the filter mouthpieces 3 shown in FIG. 2 is that each filter mouthpiece 3 is provided with a relatively short strip 2, i.e., with a strip having a length which is a fraction of the length of the respective mouthpiece 3. On the other hand, the machine of FIG. 3 turns out filter rod sections 3' each having a strip 2 which is as long as the filter rod section 3'. However, the functions of both types of (shorter and longer) strips are the same, i.e., they constitute the identifying indicia in the array or group 6 or 6' of a cigarette pack 4 or 4'.

The manner in which the filter cigarettes (4 or 4') can be assembled into quincunx formations (6 or 6') or analogous formations is disclosed, for example, in commonly owned U.S. Pat. No. 4,471,886 granted Sep. 18, 1984 to Erdmann et al. for "APPARATUS FOR ASSEMBLING ARRAYS OF CIGARETTES IN PACKING MACHINES".

It is also possible to replace the metallic web 2A with a web having a specific color (e.g., a color sufficiently different from that of the web 18 and/or from that of the tow 13) so that it can be readily detected by a color-sensitive detector replacing the detectors 7 and 8.

The filter rod sections 3' which leave the filter rod making machine of FIG. 3 and are thereupon assembled with plain cigarettes of unit length (e.g., in a manner as disclosed in U.S. Pat. No. 5,135,008 to Oesterling et al.) prior to being introduced into the machine of U.S. Pat. No. 4,471,866 to Erdmann et al. ultimately form part of groups 6' of the type shown in FIG. 4. Each such group 6' comprises nineteen filter cigarettes 1' of unit length and the strips 2' (which are longer than the strips 2 of FIG. 2) are in random (haphazard) distribution insofar as their angular positions are concerned. The advantages of such random distribution are the same as those already described with reference to FIGS. 1 and 2.

Figure 4:
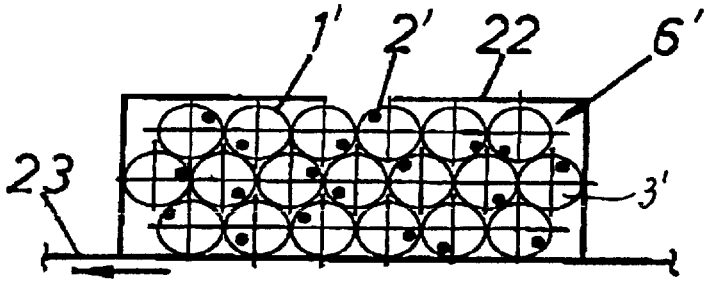
FIG. 4 is a schematic elevational view of a conveyor for the transport of receptacles in a packing machine which is set up to accumulate filter cigarettes into groups, arrays or formations each of which includes nineteen filter cigarettes each including a filter mouthpiece of the type turned out by the machine shown in FIG. 3.

The receptacle 22 shown in FIG. 4 corresponds to one of the receptacles or pockets 3 shown in FIG. 2 of U.S. Pat. No. 4,471,866 to Erdmann et al., and the reference character 23 denotes a conveyor corresponding to the conveyor 2 in FIG. 2 of the patent to Erdmann et al. As a rule, each of a short or long series of groups one of which is shown at 6' in FIG. 4 has a different distribution of strips 2'.

Figure 5:
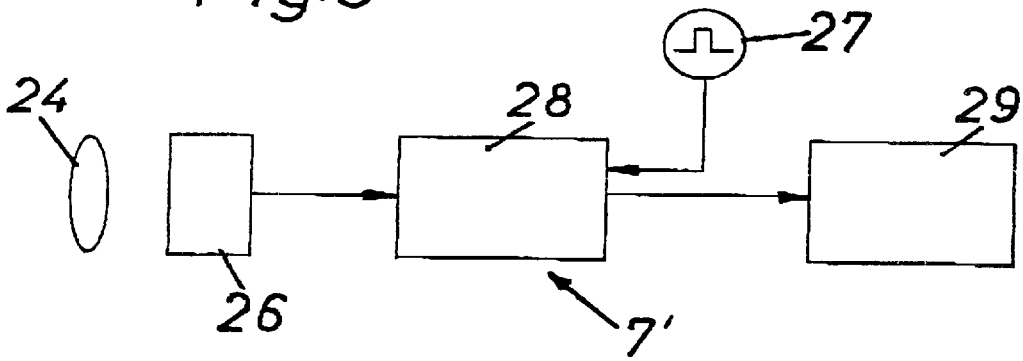
FIG. 5 is a diagrammatic view of an apparatus which is constructed and assembled to encode information pertaining to the identifying indicia in successive cigarette packs and to apply symbols denoting the encoded information to the receptacles of the respective cigarette packs.

The detector 7' of FIG. 5 serves to monitor successive formations or groups 6' during successive intervals of idleness of the stepwise advancing conveyor 23. The detector 7' can constitute a commercially available matrix camera. Alternatively, or in addition to the detector 7', the apparatus of FIG. 5 can comprise a detector 26 which can constitute a commercially available CCD camera. The latter can be positioned to monitor the front end faces of filter rod sections 3' shown in FIG. 4. The camera 26 comprises an objective lens 24; this camera can constitute a line-by-line camera of the type known as Series JR2048 distributed by the Firm Schäfter & Kirchhoff, Hamburg, Federal Republic Germany.

The reference character 27 denotes in FIG. 5 a timer which is set up to generate synchronous high-frequency pulses during stepwise monitoring or scanning of the end portions of filter rod sections 3' of the filter cigarettes 1' shown in FIG. 4. FIG. 5 further shows an image processing circuit 28 which ascertains the positions of the strips 2' and determines or sets up corresponding evaluating windows.

FIG. 4 shows, by way of example, that the cross-sectional area of each filter cigarette 1' can be subdivided into four fields 1–4 (as seen in the clockwise direction and starting at the twelve o'clock position). Other divisions or subdivisions of the cross-sectional areas of the cigarettes 1' can be selected with equal advantage. For example, each such cross-section can be divided into eight fields each of which extends along an arc of 45° to permit a more accurate determination of the locus of a strip 2'.

Referring again to FIG. 4, the strips in the uppermost row of filter cigarettes 1' are located in the first, third, second, fourth, second and third quadrants of successive filter cigarettes 1' (as seen from left to right) which adds to an encoding identified by the numeral 15. In the third or lowermost row of the group 6' shown in FIG. 4, the encoding numeral is 18, and in the median row the encoding numeral is 14. The first quadrants extend from 0° to 90° (i.e., from the twelve o'clock to the three o'clock position), the second quadrants extend from 90° to 180°, and so forth. Such information is processed (encoded) by the circuit 28 which generates a symbol that is imprinted upon or otherwise applied to the packet of the respective cigarette pack (containing the group 6'). For example, the encoded information can be denoted by the numeral 47 (i.e., 15+14+18).

The reference character 29 denotes in FIG. 5 a printer which applies the encoded information (47) to the packet of the respective cigarette pack. The printer 29 can constitute an ink jet printer or an inscribing laser of any conventional design, e.g., that distributed by the German Firm IWK Verpackungstechnik GmbH (jet printers) or by the Firm Domino Laser, Inc. (inscribing lasers).

The detector 7' can further serve as a means for decoding the information which was imprinted upon or otherwise applied to the packet of the respective cigarette pack containing a group 6'. The image processing unit 28 is then replaced with a non-programmed processing unit which can decode the information previously applied by the printer 29, and the non-programmed processing unit is preferably further designed to compare the decoded information (symbol or symbols) with the information previously obtained or ascertained by the detector 7' and/or 26. The decoding assembly further employs a display which replaces the printer 29 and serves to exhibit the decoded information (the timer 27 is not necessary for the carrying out of such steps of the improved method).

The exact details of all constituents of the improved apparatus form no part of the present invention. Such constituents can be commercially available units as long as they can be assembled in the aforedescribed manner or in an analogous manner to facilitate the carrying out of the improved method.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making and packing and identifying arrays of smoker' products and other types of products and, therefore, such adaptations should and are intended to be comprehended within the meaning and range of equivalence of the appended claims.

What is claimed is:

1. A method of facilitating identification of the contents of a container for a group of rod-shaped tobacco products, comprising the steps of:

making the rod-shaped tobacco products;

providing the group with at least one identifying composite indicium by furnishing at least some of the rod-shaped tobacco products with portions of identifying indicia in the course of said making step, the at least identifying composite indicium being furnished directly on the at least some of the rod-shaped tobacco products;

confining the group in a container;

generating at least one signal which is indicative of the at least one composite indicium;

encoding the at least one signal; and applying to the container at least one decodable symbol which is indicative of the encoded at least one signal.

2. The method of claim 1, wherein the group is a block-shaped array of rod-shaped articles of the tobacco processing industry, said confining step including draping the array into at least one blank of wrapping material.

3. The method of claim 1, wherein the at least one indicium is a composite indicium and said providing step includes furnishing at least some of the rod-shaped tobacco products with portions of the composite indicium, said signal generating step including generating at least one signal which is indicative of mutual positions of portions of the composite indicium in the group.

4. The method of claim 1, wherein the at least one identifying indicium is detectable through the container and said signal generating step includes monitoring the group subsequent to said confining step.

5. The method of claim 1, wherein said providing step includes applying to at least one rod-shaped tobacco product of the group at least one foreign object which is detectable through the container.

6. Apparatus for facilitating identification of the contents of a container for a group of commodities at least one of which exhibits at least one identifying indicium, comprising:

means for generating at least one signal indicative of the at least one identifying indicium;

means for providing the at least one commodity of the group with at least one feature which causes the at least one commodity to exhibit the at least one identifying indicium;

means for encoding the at least one signal; and means for applying to the container at least one decodable symbol which is indicative of the encoded at least one signal.

7. The apparatus of claim 6, further comprising means for decoding the applied at least one symbol, and means for comparing the at least one decoded symbol with the at least one signal generated by said signal generating means.

8. The apparatus of claim 6 for facilitating identification of the contents of a container for a group of nonmetallic commodities, wherein said providing means includes means for combining said at least one commodity with at least one metallic particle.

9. The apparatus of claim 8, wherein the nonmetallic commodities comprise tubular envelopes and said at least one metallic particle is provided at the envelope of the at least one commodity.

* * * * *